US006729934B1

(12) United States Patent
Driscoll et al.

(10) Patent No.: US 6,729,934 B1
(45) **Date of Patent: *May 4, 2004**

(54) INTERACTIVE CHARACTER SYSTEM

(75) Inventors: Robert W. Driscoll, Florence, MA (US); Edward Wood, Longmeadow, MA (US); Peter Kristoffy, Longmeadow, MA (US)

(73) Assignee: Disney Enterprises, Inc., Burbank, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/510,058

(22) Filed: Feb. 22, 2000

Related U.S. Application Data

(60) Provisional application No. 60/120,912, filed on Feb. 22, 1999.

(51) Int. Cl.[7] ..... A63H 3/28

(52) U.S. Cl. ..... 446/297; 446/302; 434/393; 463/42; 340/573.1; 340/825.49; 340/10.41

(58) Field of Search ..... 446/302, 303, 446/298, 397; 463/42, 46; 434/393; 340/573.1, 825.49, 539, 573.4, 10.41

(56) References Cited

U.S. PATENT DOCUMENTS

| | | | | | |
|---|---|---|---|---|---|
| 4,245,430 | A | * | 1/1981 | Hoyt | |
| 4,479,329 | A | * | 10/1984 | Fraden | 446/175 |
| 4,824,375 | A | | 4/1989 | Weiner | |
| 4,840,602 | A | | 6/1989 | Rose | |
| 4,846,693 | A | | 7/1989 | Baer | |
| 4,850,930 | A | | 7/1989 | Sato et al. | |
| 4,857,030 | A | * | 8/1989 | Rose | 340/539 |
| 5,191,615 | A | | 3/1993 | Aldava et al. | |
| 5,461,371 | A | | 10/1995 | Matsumoto et al. | |
| 5,636,994 | A | | 6/1997 | Tong | |
| 5,648,753 | A | | 7/1997 | Martin | |
| 5,655,945 | A | * | 8/1997 | Jani | 446/175 |
| 5,733,131 | A | | 3/1998 | Park | |
| 5,746,602 | A | | 5/1998 | Kikinis | |
| 5,752,880 | A | | 5/1998 | Gabai et al. | |
| 5,797,125 | A | | 8/1998 | Hirohama | |
| 5,873,765 | A | | 2/1999 | Rifkin et al. | |
| 5,929,848 | A | | 7/1999 | Albukerk et al. | |
| 6,089,942 | A | * | 7/2000 | Chan | 446/175 |
| 6,110,000 | A | * | 8/2000 | Ting | 446/175 |
| 6,352,478 | B1 | * | 3/2002 | Gabai et al. | 463/42 |

* cited by examiner

*Primary Examiner*—Derris H. Banks
*Assistant Examiner*—Bena B. Miller
(74) *Attorney, Agent, or Firm*—Greenberg Trauring LLP; Margo Maddux; Donald L. Wenskay, Esq.

(57) ABSTRACT

An interactive character system that includes one or more toy characters and an environment, such as a theme park. Each toy character has one or more one or more electronic signal receivers, and an electronic system. The electronic system is structured to produce oral communication and has a programmable memory structured to store software. The software is structured to interact with the electronic signals and to cause the electronic system to produce the oral communication. The environment has one or more environmental electronic signal transmitters disposed therein. The toy character, one or more one or more electronic signal receivers interact with the one or more environmental electronic signal transmitters to cause the toy character electronic system to produce the oral communication.

37 Claims, 1 Drawing Sheet

INTERACTIVE CHARACTER SYSTEM

Priority of the Provisional Patent Application filed by the Inventors on Feb. 22, 1999 is claimed (Ser. No.: 60,120,912).

BACKGROUND

1. Field of the Invention

This invention is a system of communication between characters at a theme park. The inventors have created a plush toy that interacts audibly and verbally in response to fixed stimuli, within a controlled and enhanced environment to appear intelligent.

Currently in the field of art, there are interactive plush toys that react to other similar plush toys. There have also been interactive plush toys that interact with television shows. There have been interactive plush toys that interact with personal computers. To date there are no interactive plush toys that interact with human beings within a controlled environment and respond or react to pre-programmed stimuli within a controlled environment. There are no interactive plush toys that have the combined features of interaction, memory, personalized speech and intelligence within an environment as well as the ability to perform functions such as play games interactively with a human being.

The interactive toys have not interacted within an environment that can be traveled through. No other interactive toy has performed intelligently within its surroundings and in response to those surroundings. No other interactive toy has committed experiences of an environment to memory for recall at a later date. No other interactive toy has combined the expanse of features of this invention.

2. Description of the Background Art

A visit to a theme park can be a very important vacation for a child, which will include preparation for the visit to heighten expectations and improve the quality of the visit. This invention responds to a need to enhance to a greater degree the interaction that a child has with a theme park to improve the child's experience at the theme park and to increase the desire to return to the theme park. Depending upon the age of the child, the degree of involvement that the child feels with the characters at the theme park as well as the fixed features within the theme park environment, will improve the experience for the child. The purpose of this invention is to increase the enjoyment and excitement experienced by a child upon a visit to a theme park.

There are various features of the theme park environment which are fixed, which do not move and with which there can be some pre-arranged electronic device embedded within the feature which will react with a mobile device with which it comes in contact. This reaction will be in the form of a verbal communication between the fixed feature of the environment and a mobile device such as a plush toy held by a child visiting the park. The content of the interaction can be in the form of information to assist a visitor in finding another location or to assist a visitor in experiencing to a greater degree the attraction relative to the feature with which the plush toy is interacting.

Personal electronic devices have been designed and an example is such is as set forth in the Albukerk patent (U.S. Pat. No. 5,929,848) which receive IR (infrared) signals from objects or exhibits in a facility. In the case of Albukerk, the facility is most likely a museum. These signals identify which object is closest to the device. The device then pulls information about that object from its internal memory and provides audio feedback to the user about the object. The Albukerk device is designed to enhance the experience of museum viewer to the museum display. Albukerk also teaches personal devices that can be linked via infrared so that one device can operate as the master device. This master device can receive object identification information and pass that information on to other personal devices. Similarly, prior art, specifically Rose (U.S. Pat. No. 4,857,030) teaches devices (dolls) which communicate with similar devices via RF (radio frequency) in order to stimulate an intelligent conversation between two or more dolls. The Interactive Character System interacts within a theme park environment, an exterior environment, not within one particular building. The plush toy character in the interactive plush concept will receive identification information about a specific location within a theme park. The location could be the park's main entrance, a particular ride or attraction's main entrance, or a section or part of a ride. Some of these places within the theme park will be within facilities and some will be outdoors within the theme park grounds. The Interactive Character System can also receive information relative to timing within a ride. For example, in the event that most of a particular ride takes place within one main location, for example an elevator, one transmitter within the elevator can transmit different signals to let the devices know which feature of the ride is occurring. The combination of place and time signals can allow the device to provide anticipatory information to the user such as "We're at the pirates of the Caribbean" or "Hold on, there's a waterfall up ahead".

The interactive plush character toy will also receive infrared (line of sight) and radio frequency (non-line of sight) transmissions. This will allow the device to react more intelligently. Infrared signals will be used to let the user know about objects or places within the user's eyesight. For example, it will exclaim "look at the dancing bears" in response to receiving a transmission from the dancing bears. Radio frequency signals will be used to let the user know about objects or places that lie ahead. For example, the device will "see" a waterfall that is around a corner and is not yet visible to the child and react by saying something like, "There's a waterfall coming up."

Unlike Albukerk, the Interactive Character Systems allows the user to own the interactive plush devices, which gives rise to additional possibilities for communication not found in prior art. The device, being the toy, will learn about the facility as the user tours by storing identification information in its memory for future use.

The interactive plush character in the current invention will also send communications between other personal devices, but unlike the type of communications referred to the Albukerk patent (used to spread information about objects in a particular facility), the interactive plush concept will use this electronic communication to simulate an oral communication between multiple devices or characters. This type of interdevice communication is not found in Albukerk. It is also unlike Rose in that it will make use of both infrared and radio frequency communication to seem more intelligent than the Rose dolls. It is also an improvement over the Rose invention in that the interactive plush character can have the owner's name in memory. The interactive plush character can then make direct references to its owner during conversation between two or more characters. For example, "Hi Mickey, this is my friend Billy." The interactive plush character can "learn" about its environment and introduce that knowledge into its play pattern. None of the communication that occurs in the prior art is triggered by environmental stimuli. So, the interactive plush character can appear to "learn" from "seeing" and "doing." The prior art cannot accomplish this.

The Interactive Character System includes communication between the device, the small plush character and large mobile characters that move throughout the theme park. This type of communication will be similar to the device communication in that it can simulate a conversation between characters. The communication in the current invention will not be between two similar devices but instead between the plush character owned by the child and a large mobile character owned by the theme park. It will also be quite different in that it can help the child owner to locate by using radio frequency communication the large mobile characters within the park. This feature is completely unique.

The present invention will allow the child/owner to program its own name into its memory. This allows the character to refer to its owner by name during all activities.

The interactive plush concept will have an event memory such that if a child moves through the theme park, the device will store information about each location, object or character that interacted with the device. This memory can later be accessed by the child owner so that the character can appear to intelligently reminisce about a visit to the theme park once the child is back home. For example, "We had a lot of fun today at the Magic Kingdom. My favorite ride was Space Mountain. What was your favorite ride, Billy?" or weeks later and triggered by switches activated by an adult, "Remember when we went to Disney World? I loved the Haunted Mansion. Did that scare you?"

The interactive character will have within its memory a feature which may be activated by parents to remind the child of their trip to a theme park and to indicate to the child that a return trip will be planned.

The Interactive Character System will have a feature to welcome the child by name to the theme park when the child receives the toy for the first time. For example, "Hi, Billy! Welcome to Disney World. We're going to have a great time."

As an additional feature, the Interactive Character System will include the capability to insert cartridges with additional speech and game play activities. Thus, adding game play allows the character to help a child build a puzzle, play a game or read a book, which may or may not be related in some way to the theme park visit.

The Interactive Character System includes a transmitter in the form of a badge for the child owner of the toy which will allow the toy to react personally with its child owner. To facilitate this, the child would receive a personal transmitter to wear on his or her body which will transmit a signal to the plush character when the child, whose name is stored in a plush character's memory, is within eye contact or infrared transmission contact. At that point, the toy will react personally with its child owner welcoming the child to the theme park.

The Interactive Character System is unique in that the theme park environment will contain receivers as well as transmitters. In the prior art, the devices supply information (receivers only) to the user based on objects within an environment. Thus, intelligent communication is transmitted only one way from the device to the owner. The current invention allows for two-way intelligent communication because it includes receivers as well as transmitters. The Interactive Character System allows for the environment to react to the plush character. For instance, a character within a theme park ride can sense via reception of an IR or RF signal that a plush character is nearby and may initiate a conversation with that character. For example, "There's Mickey. Hi, Mickey. Are you enjoying the ride?"

If plush characters that their owner's name in memory, a theme park character within a ride (or anywhere within the theme park) or one of the large mobile characters may communicate by name with the child owner of the plush character. If the plush character sends a signal to the theme park environment that it is present, it can also transmit the name of its owner. Now the theme park environment can react personally with the child owner. For example, "Hi, Billy. I see you brought Mickey with you. How do you like the ride?"

The interactive plush character can also provide helpful hints to the child owner and the child owner's parents concerning the theme park environment, such as when and where a particular character will be at a certain place and suggestions for particular rides which may be appropriate for certain age children.

3. BRIEF SUMMARY OF THE INVENTION

The invention is a system of interaction of a toy character to its owner throughout an environment. The invention includes embedded IR (infrared) and RF (radio frequency) transmitters/receivers placed in characters and in other locations throughout a controlled environment to trigger appropriate (intelligent) responses from a toy character (most likely a plush toy) carried by a child through a theme park. The IR or RF transmitters/receivers are placed, for example in locations throughout structures, within large mobile licensed characters, in a badge held by the owner and in the plush toy itself. IR is used when direct line of sight communication is either preferred or necessary. RF is used when direct line of sight communication is neither possible nor desired. The software and speech data in the plush toy will be developed to cause appropriate (intelligent) responses to occur in response to these interactions. The software will also contain simple yes or no speech recognition for further interaction with the owner. The toy character reacts to an environment consisting of structures and mobile characters. This provides for guide capabilities and intelligent audio responses which add value to the toy and make it more magical to its child owner.

The invention consists of the entire system made to work within a controlled environment. The toy character will be programmed to remember its visit to the environment to be recalled and recounted at a later time by the owner.

The invention creates an intelligent toy character by allowing it to know, recognize, and react to its immediate surroundings. It allows a child to relive his or her recent vacation through memory sharing and interaction with the child when the child leaves the park.

4. PREFERRED EMBODIMENT OF THE INVENTION

A. General Description

This invention is based on the concept of creating a toy that interacts with another toy of the same type, its owner and a controlled environment. The toys will most likely be plush and reflect the likeness of licensed theme park characters. The preferred embodiment consists of toy characters that interact with other characters or with fixed objects or human beings in response to stimuli within a theme park environment, where the toy character will interact verbally as a friend and tour guide to the child.

B. Main Components of the Preferred Embodiment

1. Toy Character:

The toy character will have IR (infrared) and RF (radio frequency) transmitter/receiver parts imbedded within its body that will allow for communication between the toy character and (i) other characters, (ii) its owner or (iii) the surrounding theme park environment. The toy characters will contain electronics capable of reproducing speech, sound effects and music. The speech may be programmed in any foreign language or English. The toy characters will contain software which will react appropriately to signals received from the theme park environment by outputting appropriate messages through electronic speech. The toy characters may be pre-ordered to contain personalized speech data so that the owner's name and other personal information will be programmed into audio responses. Also, some of the speech may be related to particular theme parks (i.e., Disney World$^R$ versus Disneyland$^R$). Toy characters may be pre-programmed and distributed to the appropriate theme park as added value features of a visit to the park. The toy characters will store information about each new location (triggered by IR or RF communications) in memory for future play by the owner following the visit to the park. The toy character will also have a childproof switch whereby parents may activate the toy character to suggest a return trip to the theme park. The toy characters will contain electronic hardware and software for simple (yes or no responses) speech recognition. Each toy character may contain a cartridge connection for future expansion of speech and/or play features.

2. Cartridges/Peripherals:

The cartridges will consist of memory containing electronic speech data and additional program information. This information will allow the toy characters to play games, make puzzles, read books and perform other interactive functions with the owner. The peripherals may include games, puzzles, books or other interactive activities designed to work with software contained in either the character itself or an attached cartridge.

3. Owner's Transmitter:

The owner will have a device, most likely a badge that will contain an IR transmitter. This device will transmit a signal to the toy character so that the toy character will react to the owner's presence via electronic speech.

4. Stationary Environmental Transmitters:

The environment, for example, a theme park, will contain many IR and RF transmitters placed in strategic locations (on rides, at hotel lobbies, in restaurants, in transportation vehicles or other auxiliary places). The transmitters will send signals to each toy character to indicate where the toy character is located in the theme park. The toy characters will then output speech relevant to the current location to act as a guide or to prompt recognition of target areas within the park. IR transmitters will be used in locations where the line of sight communication is the most appropriate form, i.e., where the toy character and thus the visitor holding the toy character is within the line of sight of the target area. RF transmitters will be used for non-line of sight communication.

5. Roving Environmental Transmitters:

The theme park environment may contain IR and RF transmitters located on moving objects, such as large mobile licensed characters. These transmitters will allow, through transmitted signals, for the toy characters to react to the large licensed mobile characters when nearby through electronic speech.

6. Stationary Environmental Receivers:

IR and/or RF receivers will be placed within the environment at fixed locations, which will allow for the environment to react to the presence of a toy character by appropriate electronic speech. Further, receivers paired with a transmitter will be programmed with electronics capable of outputting speech, sound effects or music.

BRIEF DESCRIPTION OF THE DRAWING

Attached is FIG. 1 which is a schematic of the components of the system which together comprise the system.

Figure 1:
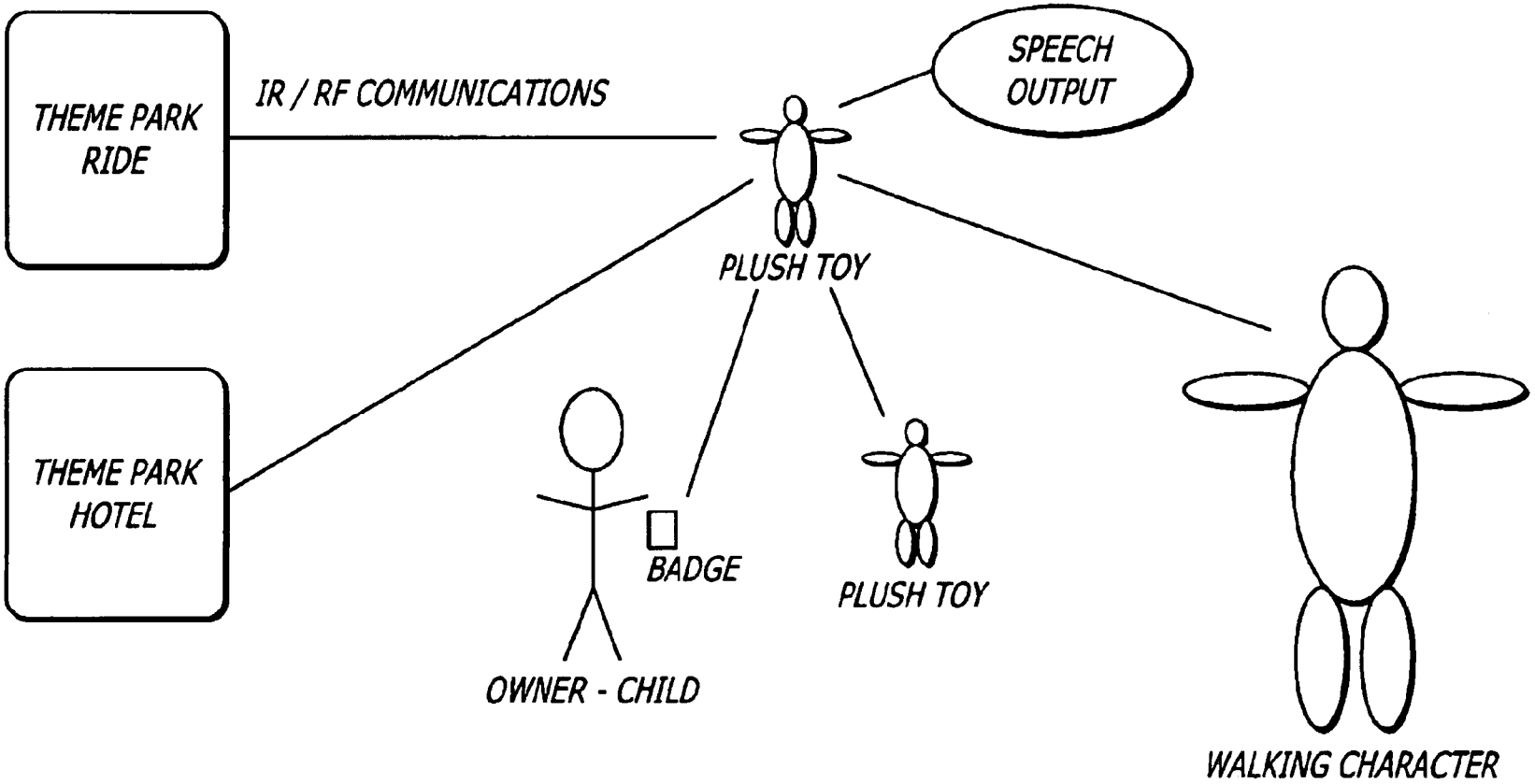
Referring to FIG. 1, in its preferred embodiment, the Interactive Character System includes the following components.

- Plush toy A (1) embedded with the ability to receive messages and transmit messages electronically in response to stimuli as well as electronics capable of reproducing speech, sound effects and music. Also embedded in plush toy A will be software which will react appropriately to signals received from the environment for outputting appropriate messages through electronic speech.
- Plush toy B (2), identical to plush toy A (1), embedded with the same electronics to receive and transmit messages in response to stimuli from and with plush toy A and vice versa.
- A walking character (3) at the theme park embedded with IR and RF transmitter/receiver pairs to trigger communication between itself and plush toy A (1) and plush toy B (2).
- The owner child (4), who will have a badge (5), which badge contains an IR transmitter to facilitate communication between plush toy A and the owner child (4).
- Theme park ride (6) embedded with IR and RF transmitter receiver pairs to trigger communication between plush toy A (1) or plush toy B (2) and the theme park ride (6).
- Theme park hotel (7) embedded with transmitter receiver pairs to trigger communication between plush toy A (1) or plush toy B (2) and theme park hotel (7).

In the preferred embodiment of the Interactive Character System, a family will purchase a package to a theme park, and along with the standard theme park hotel ticket package will be included an interactive plush toy of the child's choice. The child will, for instance, choose a plush toy resembling Mickey Mouse. Before the family arrives, the Mickey Mouse plush toy will be preprogrammed with the child's name. When the family reaches the theme park hotel, the child will receive a key chain or badge containing an IR transmitter. When the family reaches their room, the plush toy will be in the room. When the child enters the room, the transmitter will trigger the plush toy to welcome the child (using his or her name) to the theme park. As the child and the plush toy travel throughout the theme park, the plush toy will serve as a friend and tour guide with phrases triggered by environmental transmitters throughout the theme park environment. If the child's friend or sibling has his or her own interactive plush character, the two characters will communicate through audio messages triggered by infrared communication. When the trip is over, the characters will continue to communicate about the adventures using the memory devices. When the child's parents decide that they wish to make a return trip to the theme park, they will program the interactive plush character with appropriate information in advance. The character will then communicate the upcoming trip to the child and reminisce about the prior adventure.

While the present invention has been described in detail, it will be readily appreciated to those skilled in the art that modifications and variations in addition to those mentioned above, may be made without departing from the scope and spirit of the invention. Such modifications are to be considered as included in the following claims:

We claim:

1. An interactive character system comprising:

one or more toy characters, each toy character having a head and limb portion, one or more wireless electronic signal receivers structured to receive an wireless signal, and an electronic system, said electronic system having a programmable memory structured to store software and preprogrammed data, said software structured to interpret a received electronic signal and to trigger playback of preprogrammed data related the received electronic signal; and an environment having disposed therein one or more environmental signal transmitters structured to transmit an electronic signal indicating a location within said environment;

wherein said toy character is carded by a person within the environment, and produces an oral communication associated/related to a location within the environment in response to receiving an electronic signal.

2. The interactive character system of claim 1, wherein said software is further structured to recognize audio signals.

3. The interactive character system of claim 2, wherein said audio signal is human speech.

4. The interactive character system of claim 1, wherein said one or more environmental transmitters includes at least one roving environmental transmitter and at least one stationary environmental transmitter.

5. The interactive character system of claim 4, wherein said at least one roving environmental transmitter is disposed on a moving object.

6. The interactive character system of claim 5, wherein said moving object is a large character.

7. The interactive character system of claim 1, wherein said environment includes a theme park and a hotel.

8. The interactive character system of claim 1 wherein said oral communication includes simulated speech, sound effects and music.

9. The interactive character system of claim 1 wherein said electronic signal is an infrared signal, said receiver is an infrared receiver and said environmental signal transmitter is an infrared transmitter.

10. The interactive character system of claim 1 wherein said electronic signal is a radio frequency signal said receiver is a radio frequency receiver and said environmental transmitter is a radio frequency transmitter.

11. The interactive character system of claim 1 wherein the toy character produces said oral communication at a time substantially after receiving the signal.

12. The interactive character system of claim 1 wherein said electronic system is structured to store said wireless signal in its memory, and to read said memory and produce an oral communication relevant to said at least one or more environmental transmitter at a later time when said toy is not within said theme park.

13. An interactive character system comprising:

an environment having disposed therein one or more wireless signal transmitters structured to transmit a wireless signal indicating a location within the environment; and one or more portable toy characters, each toy character comprising a head and limb portion;

a wireless signal receiver structured to receive a wireless signal;

electronics capable of playing audio data, the audio data reproducing an oral communication;

a programmable memory for storing pre-programmed data, the pre-programmed data comprising audio data related to a location within said environment; and software stored in said programmable memory, said software structured to process a received wireless signal and to cause said electronic system to locate and play said pre-programmed audio data to produce said oral communication; and wherein said toy character is carried by a person throughout the environment, and acts as a personal tour guide to the person by producing oral communication related to the location in the environment.

14. The interactive character system of claim 13 wherein said wireless signal receiver is an infrared receiver and said environmental signal transmitter is an infrared transmitter.

15. The interactive character system of claim 13 wherein said wireless signal receiver is a radio frequency receiver and'said environmental transmitter is a radio frequency transmitter.

16. An interactive character system comprising:

an environment having disposed therein one or more wireless signal transmitters structured to transmit a wireless signal indicating a location within the environment and one or more wireless signal receivers; and one or more portable toy characters, each toy character comprising a head and limb portion;

a wireless signal receiver structured to receive a wireless signal;

a wireless signal transmitter structured to transmit a wireless signal;

electronics capable of playing audio data, the audio data reproducing an oral communication;

a programmable memory for storing pre-programmed data, the pre-programmed data comprising audio data related to a location within said environment; and software stored in said programmable memory, said software structured to process a received wireless signal and to cause said electronic system to locate and play said pre-programmed audio data to produce said oral communication; and wherein said toy character is carried by a person throughout the environment, and acts as a personal tour guide to the person by producing oral communication related to the location in the environment.

17. The interactive character system of claim 16 wherein said wireless signal is an infrared signal, said receiver is an infrared receiver and said environmental signal transmitter is an infrared transmitter.

18. The interactive character system of claim 16 wherein said wireless signal is a radio frequency signal, said receiver is a radio frequency receiver and said environmental transmitter is a radio frequency transmitter.

19. The interactive character system of claim 16, wherein:

said one or more environmental transmitters includes at least one roving environmental transmitter and at least one stationary environmental transmitter; and said one or more environmental receivers include at least one roving environmental receiver and at least one stationary environmental receiver.

20. The interactive character system of claim 6 further comprising a badge containing an infrared transmitter, the badge worn by the toy's owner, and for facilitating communication between the owner and its toy.

21. An interactive character system comprising:

an environment having disposed therein one or more environmental signal transmitters configured to transmit a first electronic signal indicating a location within said environment; and one or more toy characters that can be carried by a person within said environment, each of the one or more toy characters having a head and limb portion and an electronic system comprising:

one or more electronic signal receivers configured to receive the first electronic signal;

a programmable memory configured to store software and preprogrammed data; and a processor that utilizes the software to interpret the first electronic signal that was received, triggers a playback of the preprogrammed data related to the first electronic signal that was received, and produces an oral communication associated with a location within the environment in response to the first electronic signal.

22. The interactive character system of claim 21, wherein the first electronic signal is an audio signal.

23. The interactive character system of claim 21, wherein the electronic system further comprises one or more electronic signal transmitters configured to transmit a second electronic signal to said environment.

24. The interactive character system of claim 21, wherein said environment has disposed therein one or more environmental signal receivers configured to receive the second signal.

25. The interactive character system of claim 21, wherein said environment includes a theme park and a hotel.

26. The interactive character system of claim 21, wherein said one or more environmental transmitters includes at least one roving environmental transmitter.

27. The interactive character system of claim 21, wherein said one or more environmental transmitters includes at least one stationary transmitter.

28. An interactive character system comprising:

an environment having positioned therein one or more radio frequency transmitters, one or more infrared transmitters, and a communications module that selects between an infrared mode tat utilizes the one or more infrared transmitters and a radio frequency mode that utilizes the one or more radio frequency transmitters to transmit a first electronic signal indicating a location within said environment; and one or more toy characters that can be carried by a person within said environment, each of the one or more toy characters having a head and limb portion and an electronic system comprising:

one or more electronic signal receivers configured to receive the first electronic signal;

a programmable memory configured to store software and preprogrammed data; and a processor that utilizes the software to interpret the first electronic signal that was received, triggers a playback of the preprogrammed data related to the first electronic signal that was received, and produces an oral communication associated with a location within the environment in response to the first electronic signal.

29. The interactive system of claim 28, wherein the communications module initially selects the infrared mode.

30. The interactive system of claim 29, wherein the communications module selects the radio frequency mode if the one or more toy characters are not in the line of sight of the one or more infrared transmitters.

31. The interactive character system of claim 28, wherein said environment includes a theme park and a hotel.

32. The interactive character system of claim 28, wherein said one or more infrared transmitters includes at least one roving environmental transmitter.

33. The interactive character system of claim 28, wherein said one or more radio frequency titters includes at least one roving environmental transmitter.

34. The interactive character system of claim 28, wherein said one or more infrared transmitters includes at least one stationary transmitter.

35. The interactive character system of claim 28, wherein said one or more radio frequency transmitters includes at least one stationary transmitter.

36. The interactive character system of claim 28, wherein the electronic system further comprises one or more electronic signal transmitters configured to transmit a second electronic signal to said environment.

37. The interactive character system of claim 30, wherein said environment has disposed therein one or more environmental signal receivers configured to receive the second signal.

* * * * *